US005975524A

United States Patent [19]

Döpke et al.

[11] Patent Number: 5,975,524

[45] **Date of Patent: *Nov. 2, 1999**

[54] SHEET-GUIDING DEVICE ASSEMBLY WITH A SHEET HOLD-DOWNER

[75] Inventors: Stefan Döpke, Eppelheim; Burkhard Maass, Heidelberg, both of Germany

[73] Assignee: Heidelberger Druckmaschinen AG, Heidelberg, Germany

[ * ] Notice: Under 35 U.S.C. 154(b), the term of this patent shall be extended for 200 days.

[21] Appl. No.: 08/638,429

[22] Filed: Apr. 26, 1996

Related U.S. Application Data

[62] Division of application No. 08/536,999, Sep. 29, 1995, abandoned.

[30] Foreign Application Priority Data

Oct. 1, 1994 [DE] Germany ..... 44 35 264

[51] Int. Cl.[6] ..... B65H 9/04

[52] U.S. Cl. ..... 271/245; 271/253; 271/236; 271/229

[58] Field of Search ..... 271/229, 236, 271/245–247, 253–255

[56] References Cited

U.S. PATENT DOCUMENTS

| | | | |
|---|---|---|---|
| 1,068,406 | 7/1913 | Pakke | 271/253 |
| 1,134,822 | 4/1915 | Cross | 271/247 |
| 3,173,685 | 3/1965 | Backhouse | 271/245 |
| 4,328,961 | 5/1982 | Wegel . | |
| 4,402,266 | 9/1983 | Sugiyama | 271/245 X |
| 4,896,875 | 1/1990 | Gotschewski | 271/236 |
| 4,995,858 | 2/1991 | Stab | 271/245 X |
| 5,087,028 | 2/1992 | Fröhlich . | |
| 5,297,789 | 3/1994 | Filsinger et al. | 271/253 X |

FOREIGN PATENT DOCUMENTS

| | | | |
|---|---|---|---|
| 603541 | 8/1960 | Canada | 271/246 |
| 0282828 | 9/1988 | European Pat. Off. . | |
| 1089774 | 9/1960 | Germany | 271/245 |
| 2609879 | 3/1978 | Germany . | |
| 2937541 | 3/1981 | Germany . | |
| 8703993 | 6/1987 | Germany . | |
| 3831770 | 4/1989 | Germany . | |
| 8902453 | 5/1989 | Germany . | |
| 5-88942 | 12/1993 | Japan . | |

*Primary Examiner*—William E. Terrell
*Assistant Examiner*—Patrick Mackey
*Attorney, Agent, or Firm*—Herbert L. Lerner; Laurence A. Greenberg

[57] ABSTRACT

Sheet-guiding device assembly includes at least one sheet hold-downer disposed on a movable protective guard.

11 Claims, 6 Drawing Sheets

SHEET-GUIDING DEVICE ASSEMBLY WITH A SHEET HOLD-DOWNER

This is a division of application Ser. No. 08/536,999, filed Sep. 29, 1995 now abandoned.

BACKGROUND OF THE INVENTION

Field of the Invention

The invention relates to a sheet-guiding device assembly with a sheet hold-downer for a sheet-processing machine.

The published non-prosecuted Japanese Patent Application 5-88942 discloses a small plate for holding down sheets of paper which is displaceably supported on a crossbar or traverse extending transversely to a sheet feeding direction and which is disposed so as to be swivellable about a bolt in order to adjust or set a spaced distance between a front lay seat or support and the small sheet hold-down plate.

With regard to the heretofore known device of the foregoing Japanese publication, it is of considerable disadvantage that a large amount of space is required therefor. Moreover, a danger arising with the use thereof is that scratches will be made in the printed subject by the point of the small sheet hold-down plate, and the scratches will impair the quality of the print.

SUMMARY OF THE INVENTION:

It is accordingly an object of the invention to provide a sheet-guiding device assembly with a sheet hold-downer or hold-down device for a sheet-processing machine, which will not scratch a printed subject, for example.

With the foregoing and other objects in view, there is provided, in accordance with the invention, a sheet-guiding device assembly, comprising at least one sheet hold-downer disposed on a movable protective guard.

In accordance with another feature of the invention, the guard is swivellably supported.

In accordance with an alternative feature of the invention, the guard is slidingly supported.

In accordance with a further feature of the invention, the guard is formed with at least one aperture, and the at least one sheet hold-downer is disposed in the at least one aperture formed in the guard.

In accordance with another aspect of the invention, there is provided a sheet-guiding device assembly for a sheet-processing machine having a feeding table, comprising a swivellable sheet hold-downer displaceable towards and away from the feeding table for adjusting a spaced distance therebetween, and an energy storer having an adjustable spring force engaging with the sheet hold-downer for swivelling the sheet hold-downer counter to the spring force.

In accordance with another feature of the invention, the spring force of the energy storer is adjustable independently of the spaced distance between the sheet hold-downer and the feeding table.

In accordance with a further feature of the invention, the energy storer is a compression spring.

In accordance with an added feature of the invention, the compression spring is disposed between two adjustably supported spring abutments.

In accordance with an additional feature of the invention, the spring abutments are, respectively, displaceably supported sliding blocks.

In accordance with yet another feature of the invention, the sliding blocks are lockable.

In accordance with yet a further feature of the invention, at least one of the sliding blocks has a fine adjusting device therefor.

In accordance with yet an added feature of the invention, the fine adjusting device of the at least one sliding block has a bolt with an eccentrically supported journal pin.

In accordance with yet an additional feature of the invention, the journal pin carries the one sliding block.

In accordance with still another feature of the invention, the energy storer comprises a spring selected from the group consisting of tension springs, torsion springs, spiral springs and leaf springs.

In accordance with a concomitant feature of the invention, the assembly includes a crossbar supporting the sheet down-holder so that the sheet down-holder is displaceable thereon in a direction transverse to a sheet feeding direction.

In the device according to the invention, it is thus advantageous that a deflection of the guiding device take place counter to the force of an adjustable energy storing device, and the adjustment of the energy storing device be independent of the adjustment of spacing between the guiding device and a feed table. In the preferred exemplary embodiment, the energy storer is a compression spring. Because of this provision, very sensitive adjustment of the guiding devices to various thicknesses of paper sheets is possible. The guiding devices are therefore capable of performing a multiplicity of tasks, namely smoothening the sheets, holding the sheets down, and separating the sheets when the sheets are fed or supplied in a sheet stream wherein the sheets are disposed in a shingled, imbricated or overlapping manner.

By arranging the sheet hold-downer or hold-down device on a swivellable, slidable or otherwise displaceable guard, a good view of and access to the feeding table, pulling devices, hold-down devices, front lays, pregrippers, and sheet-guiding devices is assured.

Other features which are considered as characteristic for the invention are set forth in the appended claims.

Although the invention is illustrated and described herein as embodied in a sheet-guiding device assembly with a sheet hold-downer or hold-down device, it is nevertheless not intended to be limited to the details shown, since various modifications and structural changes may be made therein is without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
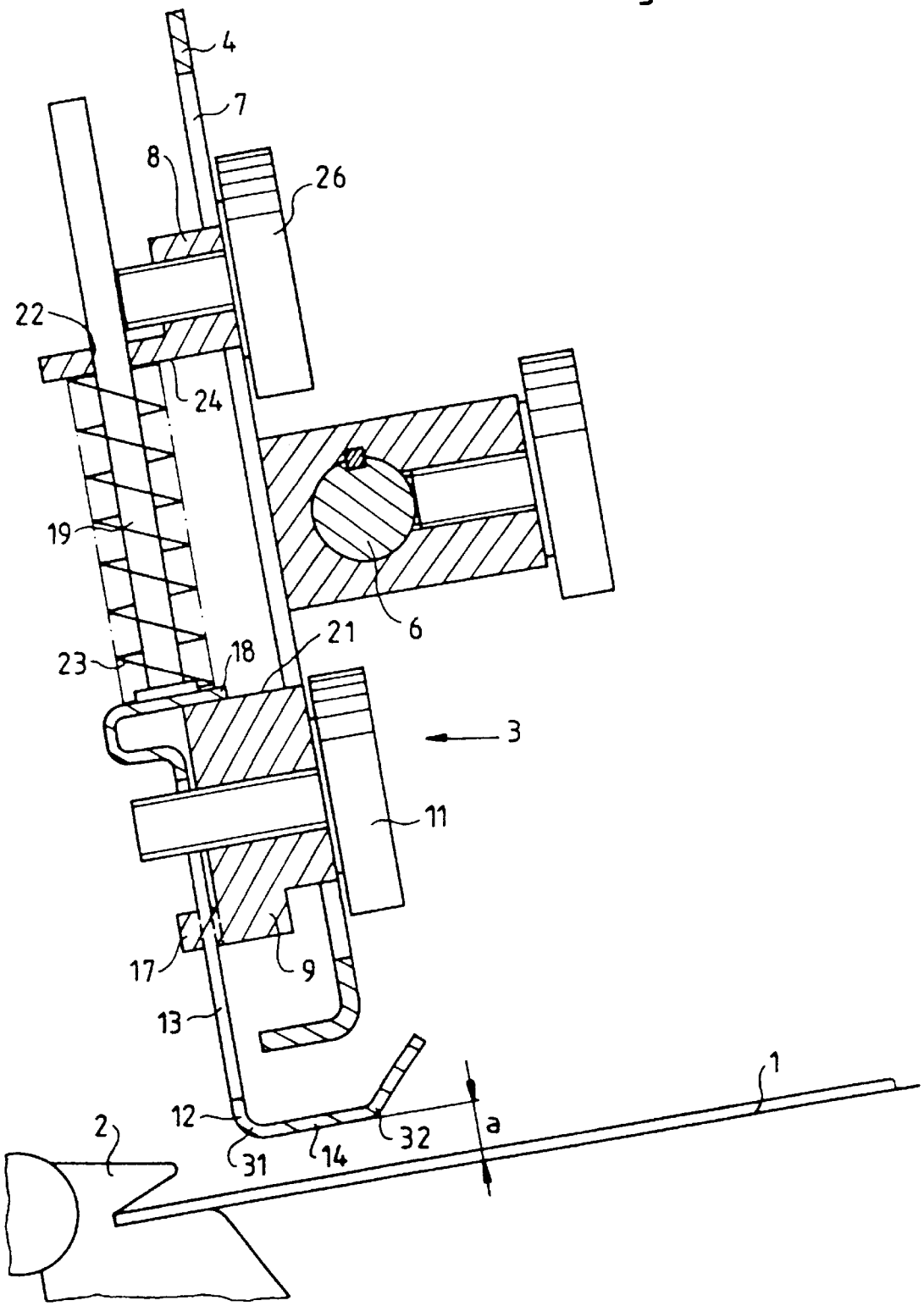
FIG. 1 is a sectional view of a device for guiding sheets with a sheet hold-downer or hold-down device according to the invention.
Figure 2:
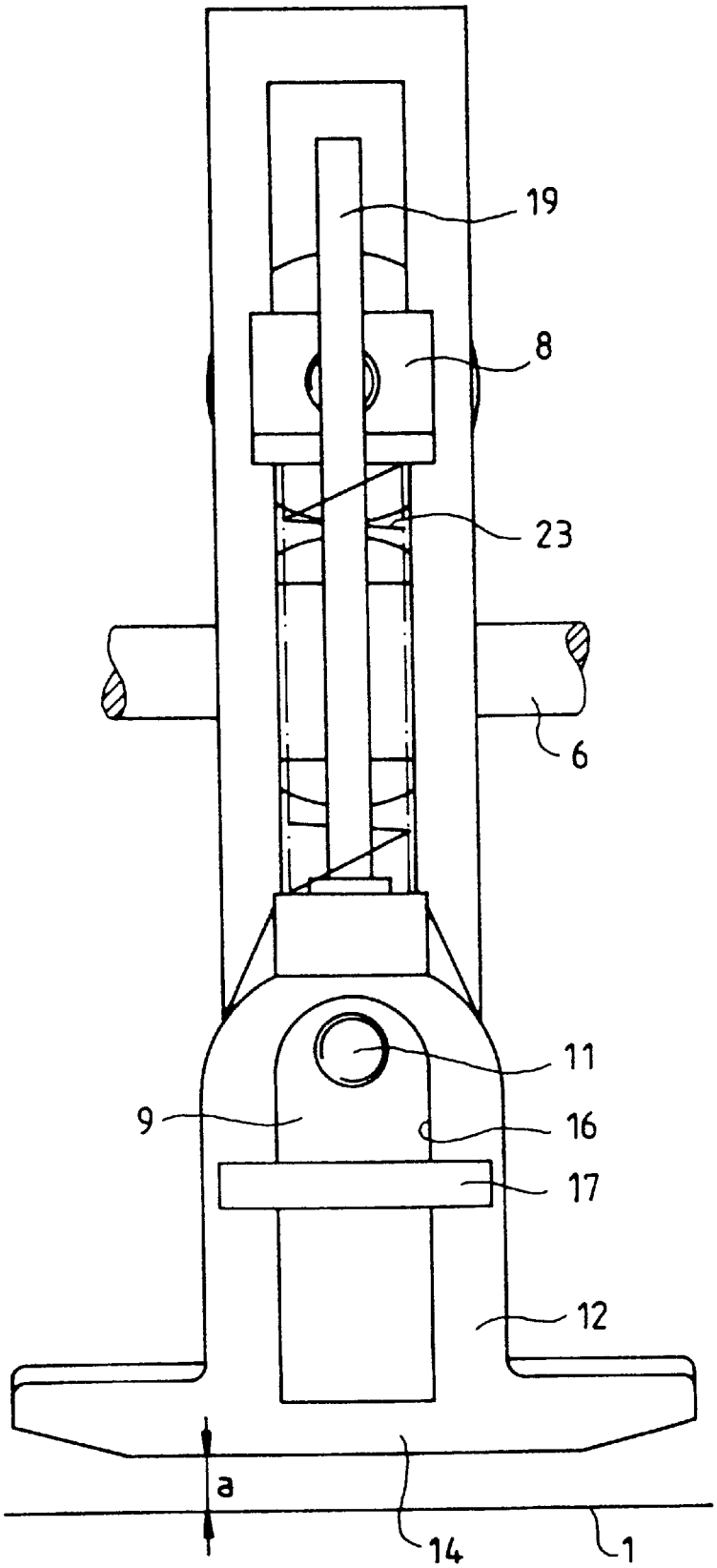
FIG. 2 is a front elevational view of FIG. 1, as seen from the left-hand side of the latter and showing the sheet-guiding device of the invention as viewed in a direction opposite to the sheet feeding direction.

Referring now to the drawing and, first, particularly to FIGS. 1 and 2 thereof, there is shown therein, above a feeding table 1 in the vicinity of top lays 2, preferably an assembly of a plurality of devices for guiding sheets of paper with so-called sheet hold-downers or hold-down devices 3. Each of the sheet hold-down devices 3 has a retaining plate 4, which is disposed on a crossbar or traverse 6 so as to be adjustable crosswise or transversely to the sheet feeding direction. An aperture 7 formed as a guide slit is provided in the retaining plate 4, and two sliding blocks 8 and 9 are arranged so as to be vertically displaceable therein. The lower sliding block 9, as viewed in FIGS. 1 and 2, can be stopped in a desired position on the retaining plate 4 by means of a knurled screw 11. The sliding block 9 forms a stop for a spring-loaded angle plate or sheet iron 12. The angle plate 12 has legs 13 and 14 extending substantially rectangularly to one another. The leg 14 is disposed parallel to the feed table 1 at an adjustable distance a therefrom (a=0 to 20 mm). The leg 13 serves to guide the angle plate 12, and is formed with a substantially rectangular aperture 16, through which a guide bar 17 of the sliding block 9 extends and laterally overlaps the leg 13. A guide rod 19 is secured to an upper end 18 of the leg 13 of the angle plate 12. The end 18 is formed as a stop and is braced against an upper side 21 of the sliding block 9. The guide rod 19 is oriented parallel to the retaining plate 4 and is slidably guided in a bare 22 formed in the upper sliding block 8. A compression spring 23 coaxially surrounds the guide rod 19 and presses at one end thereof against an underside 24 of the sliding block 8 and, at an opposite end thereof against the leg 13 of the angle plate 12, so that the angle plate 12 is held in contact with the sliding block 9 by the force of the compression spring 23.

The sliding block 8 is likewise supported so as to be vertically displaceable in the aperture 7 formed in the retaining plate 4 and is lockable in a desired position by means of a knurled screw 26.

In order to adjust the spaced distance a, the knurled screw 11 is loosened and the sliding block 9 is slid in the aperture 7 by hand until the spacing a is reached. The desired position is fixed by tightening the knurled screw 11. During this adjustment operation, the compression spring 23 keeps the end 18 of the angle plate 12 in contact with the upper side 21 of the sliding block 9. In order to adjust the force of the compression spring 23, the knurled screw 26 is loosened, and the sliding block 8 is slid into the desired position in the aperture 7, wherein it can be fixed by means of the knurled screw 26.

A shifting or sliding of the sliding block 8 downwardly, for example, results in an increase in the prestressing of the compression spring 23 and, accordingly, an increase in the spring force, which is necessary for processing relatively thick sheets (such as cardboard or carton).

The leg 14 which is provided. for guiding the sheets is rounded at respective ends or bent corners 31 and 32 thereof.

Figure 3:
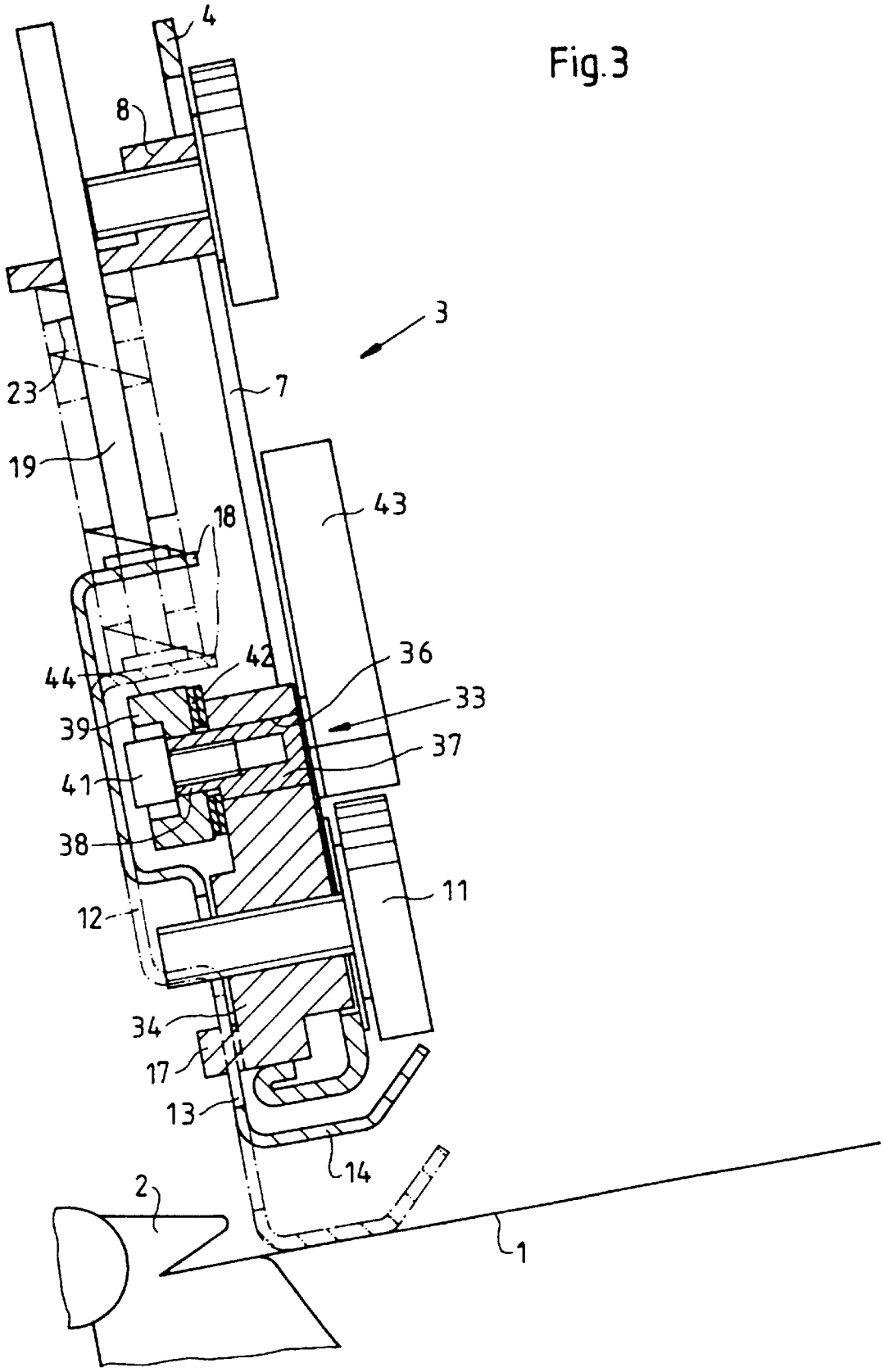
FIG. 3 is a view like that of FIG. 1 showing another embodiment of the sheet-guiding device provided with a fine adjustment device.

In another embodiment of an assembly of the device according to the invention which is shown in FIG. 3, a fine adjusting device 33 is provided for setting the spaced distance a. To that end, a sliding block 34 is formed with a bore 36 extending parallel to the knurled screw 11. An adjusting bolt 37 is swivellably supported in the bore 36. This bolt 37 has an eccentrically disposed journal 38 at the end thereof. The journal 38 carries a round part 39, which is fastened to an end face of the journal 38 by means of a fastening screw 41 and a spring washer 42 disposed between the round part 39 and the sliding block 34.

An adjusting lever 43 is secured to a control or operating end of the bolt 37.

In the embodiment of the invention shown in FIG. 3, an outer cylindrical or jacket surface 44 of the round part 39 forms a stop for the end 18 of the angle plate 12. By turning the adjusting lever 43, the round part 39 fastened to the eccentrically disposed journal 38, is adjusted in the height thereof relative to the sliding block 34. The spring washer 42 permits relative motion between the sliding block 34 and the round part 39.

In a further feature of the invention, it is also possible, in a structural modification, to provide a tension spring, torsion spring, spiral spring, leaf spring, and so forth instead of the compression spring 23, as an energy storing device.

Figure 4:
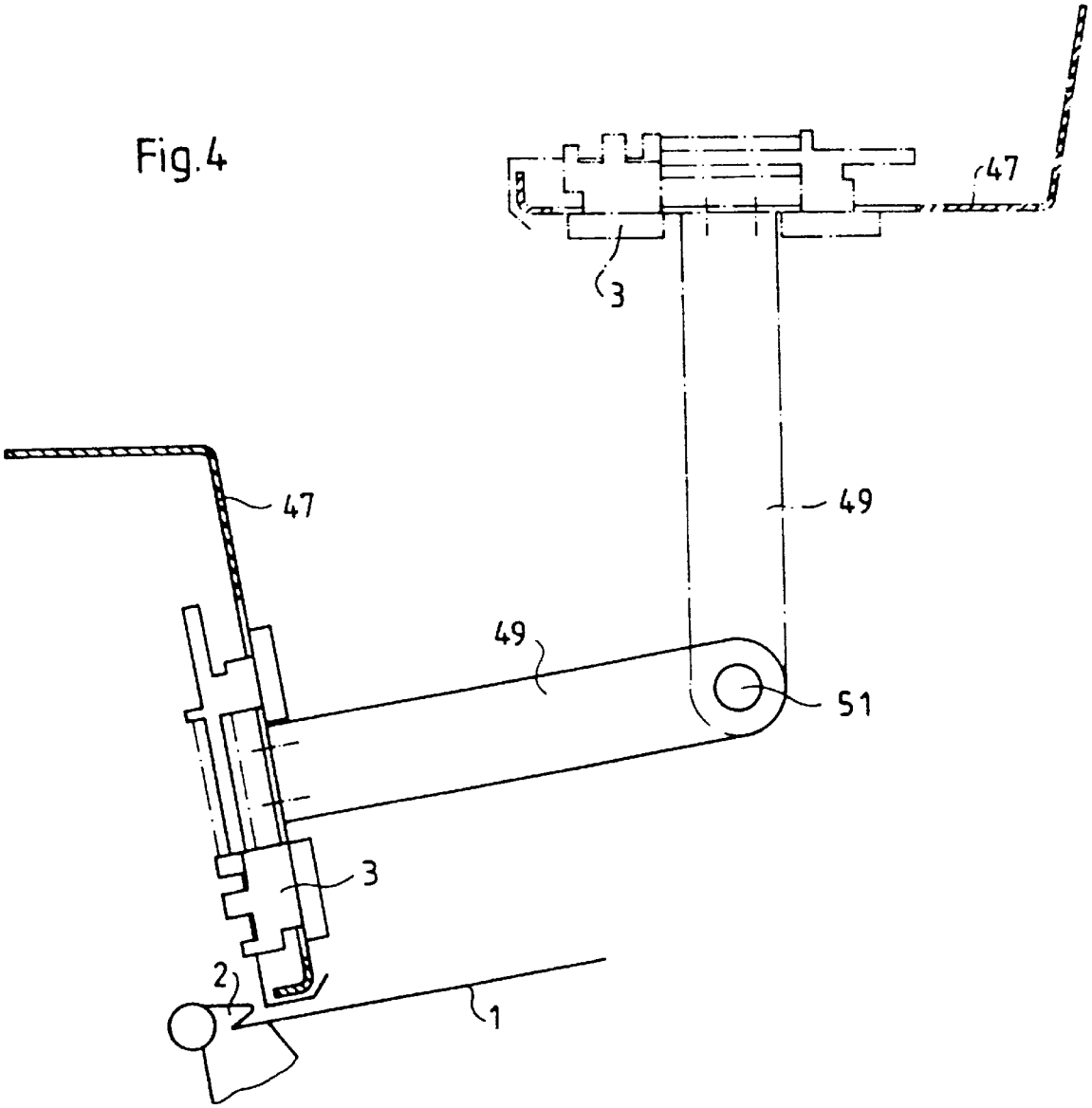
FIG. 4 is a reduced side elevational view of an embodiment of an assembly of the sheet-guiding device like that of FIG. 1 disposed on a swivellable guard.
Figure 6:
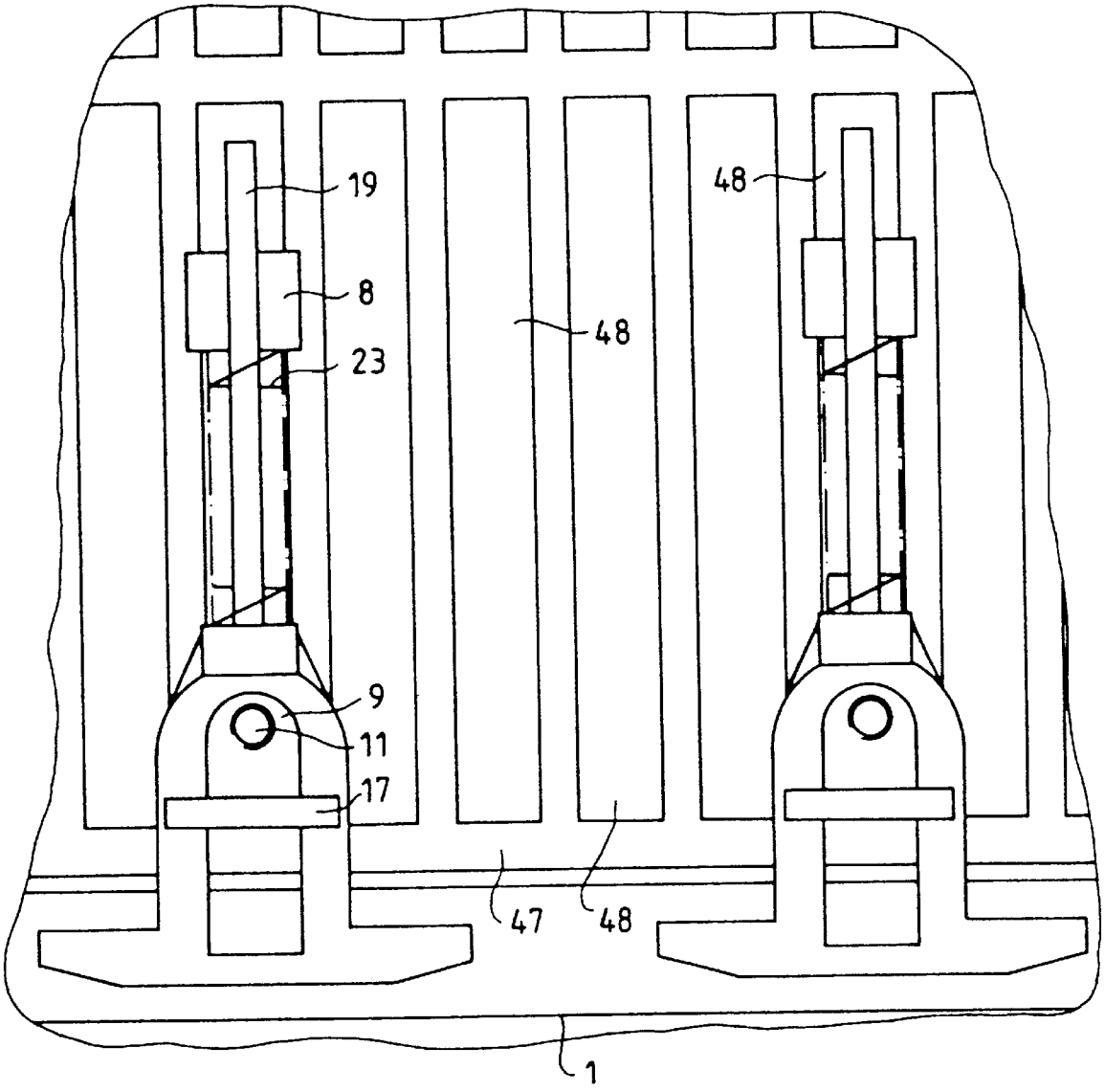
FIG. 6 is a reduced view like that of FIG. 2 of an assembly of the sheet-guiding device provided on a guard, as seen opposite to the sheet feeding direction.

FIG. 4 shows the assembly wherein the device according to the invention is disposed on a swivellable protective guard 47. The guard 47 has a number of apertures 48 (note FIG. 6) disposed parallel and adjacent to one another and corresponding to the apertures 7 in the first exemplary embodiment, as shown in FIG. 1, for example. The sheet hold-down device 3 is disposed in one or more of these apertures 48.

The guard 47 extends over the entire width or breadth of the feeding table 1 and has a respective connecting rod or coupler 49 at each of the two outer edges thereof. The connecting rod 49, at the end thereof opposite from the guard 47, is provided with an articulated joint 51 and is swivellably supported by means of this joint 51 on side frames of the feeding table 1.

Figure 5:
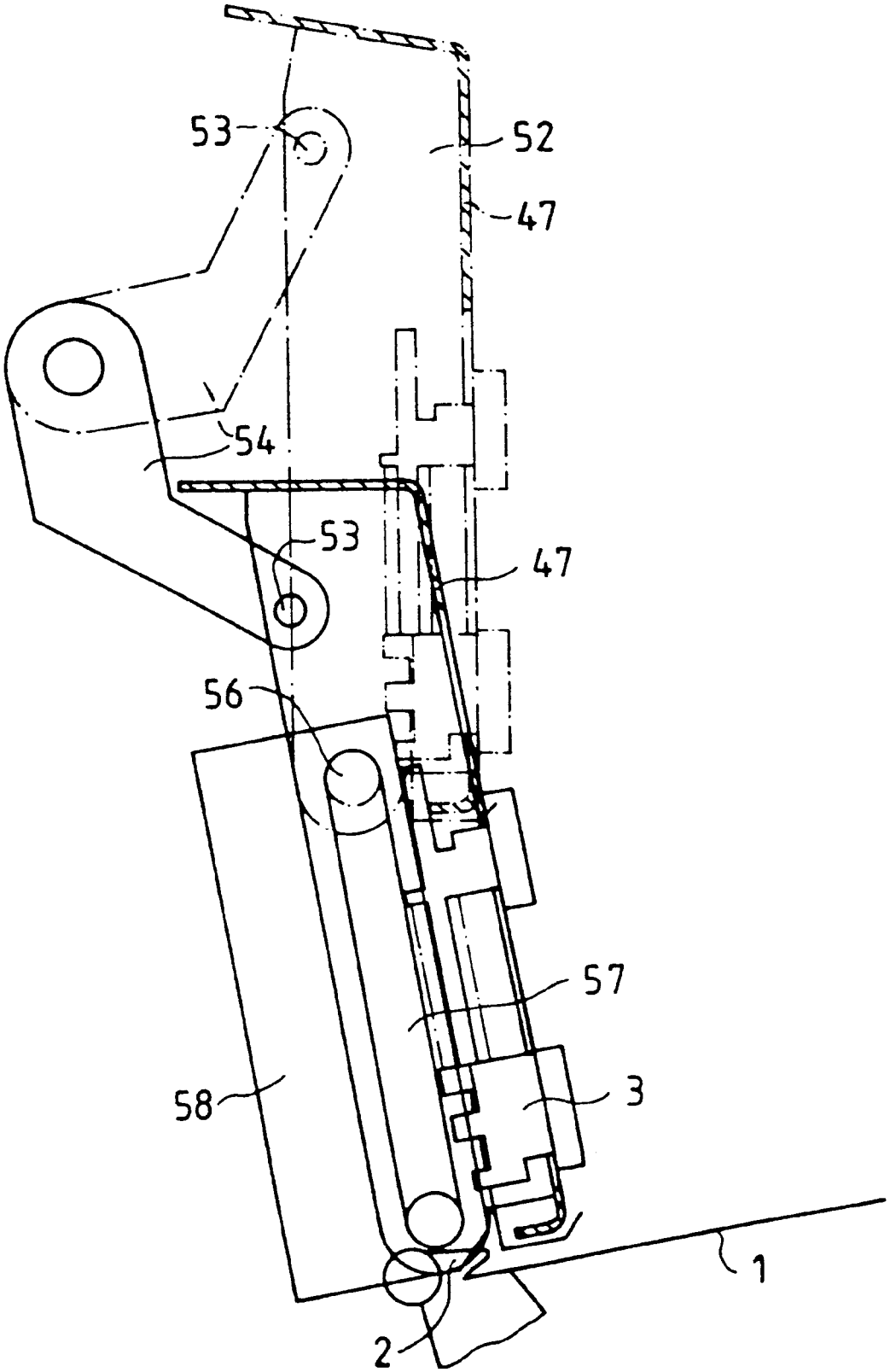
FIG. 5 is a view of an embodiment of an assembly of the sheet-guiding device like that shown in FIG. 4 disposed on a slidable guard.

FIG. 5 shows the guard 47 with a device for displacing the guard 47 out of a "closed position" into a "open position". To that end, the guard 47 is provided, respectively, at the side edges thereof with a side plate 52 disposed parallel to non-illustrated side walls of the feeder represented by the feeding table 1. In an upper region thereof, as viewed in FIG. 5, the side plates 52 have a swivellable articulating point 53 for a connecting rod 54. The connecting rod 54 is swivellably supported in the side frames. At a lower end thereof, also as viewed in FIG. 5, the side plates 52 have a journal pin 56, which engages in a guide slot 57 of a sliding guide block 58 which is likewise secured to the side frame. Non-illustrated conventional auxiliary means are provided to keep the guard 47 in the end positions thereof.

We claim:

1. In combination, a sheet-processing machine having a feeding table, and a sheet-guiding device assembly, comprising a stationary sheet hold-downer disposed above the feeding table of the sheet-processing machine, said sheet hold-downer being slidably disposed towards and away from the feeding table for adjusting a spaced distance therebetween, and an energy storer having an adjustable spring force bearing against said sheet hold-downer, said sheet hold-downer being slidably displaceable counter to said spring force.

2. Assembly according to claim 1, wherein said spring force of said energy storer is adjustable independently of the spaced distance between said sheet hold-downer and the feeding table.

3. Assembly according to claim 1, wherein said energy storer is a compression spring.

4. Assembly according to claim 3, wherein said compression spring is disposed between two adjustably supported spring abutments.

5. Assembly according to claim 4, wherein said spring abutments are, respectively, displaceably supported sliding blocks.

6. Assembly according to claim 5, wherein said sliding blocks are lockable.

7. Assembly according to claim 5, wherein at least one of said sliding blocks has a fine adjusting device therefor.

8. Assembly according to claim 7, wherein said fine adjusting device of said at least one sliding block has a bolt with an eccentrically supported journal pin.

9. Assembly according to claim 8, wherein said journal pin carries said one sliding block.

10. Assembly according to claim 1, including a crossbar supporting said sheet down-holder so that said sheet down-holder is displaceable thereon in a direction transverse to a sheet feeding direction.

11. In combination, a sheet-processing machine having a feeding table, and a sheet guiding device assembly, comprising a stationary sheet hold-downer disposed above a feeding table of the sheet-processing machine, said sheet hold-downer having a hold-down member disposed a spaced distance from the feeding table, said hold-down member being slidably disposed towards and away from the feeding table for adjusting the spaced distance, a spring bearing against said hold-down member, means for adjusting a spring force of said spring against said hold-down member independently of the spacing distance, and said hold-down member being slidably displaceable counter to said spring force.

* * * * *